US008435016B2

(12) United States Patent
Telakowski et al.

(10) Patent No.: US 8,435,016 B2
(45) Date of Patent: May 7, 2013

(54) VERTICAL SHAFT PUMPING SYSTEM WITH LUBRICANT IMPELLER ARRANGEMENT

(75) Inventors: Robert Telakowski, Windsor Locks, CT (US); Lino S. Italia, Rocky Hill, CT (US); James R. Morin, Wilbraham, MA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 288 days.

(21) Appl. No.: 12/943,359

(22) Filed: Nov. 10, 2010

(65) Prior Publication Data

US 2012/0114504 A1 May 10, 2012

(51) Int. Cl.
*F04B 39/02* (2006.01)
*F04D 1/12* (2006.01)
*F16N 7/36* (2006.01)

(52) U.S. Cl.
USPC ..... 417/372; 417/53; 415/88; 184/6.18; 184/6.16; 418/88; 418/94

(58) Field of Classification Search ..... 417/53, 417/321, 372, 415, 368, 423.13; 415/115, 415/88; 516/231 R; 184/6.16, 6.18; 418/88, 418/94, 97, 98, 102
See application file for complete search history.

(56) References Cited

U.S. PATENT DOCUMENTS 2,295,639 A * 9/1942 Drill ..... 65/519
2,423,719 A * 7/1947 Muffly ..... 417/372
2,493,467 A * 1/1950 Sunnen ..... 415/199.1
2,551,623 A * 5/1951 More ..... 417/410.3
2,766,027 A * 10/1956 Herr ..... 261/91
2,809,872 A * 10/1957 Warner ..... 384/371
2,835,437 A * 5/1958 Boynton ..... 184/6
2,898,072 A * 8/1959 Buschmann ..... 184/6
2,930,522 A * 3/1960 Reichard ..... 184/6
3,359,912 A 12/1967 Gates
3,584,980 A * 6/1971 Cawley et al. ..... 417/372
3,653,248 A * 4/1972 Leffers ..... 72/324
3,664,461 A * 5/1972 Leffers et al. ..... 184/6.16
3,704,960 A 12/1972 Zagar
3,848,702 A 11/1974 Bergman
4,178,131 A 12/1979 Sieghartner (Continued)

FOREIGN PATENT DOCUMENTS

JP 61011492 A * 1/1986

OTHER PUBLICATIONS

European Search Report, mailed May 28, 2012.

*Primary Examiner* — Devon Kramer
*Assistant Examiner* — Nathan Zollinger
(74) *Attorney, Agent, or Firm* — Kinney & Lange, P.A.

(57) ABSTRACT

A vertical shaft pumping system includes a hollow shaft with an inner bore, an inlet end and an outlet end, the outlet end with at least one liquid distribution hole. It further includes an impeller positioned at the lower inlet end of the shaft, with a cylindrical base portion with a lower end, a central hole for drawing fluid into the shaft, and a plurality of teeth extending upwards from the cylindrical base portion and extending radially from the central hole to the outer cylindrical circumference for increasing tractive force of liquid in the shaft when the impeller and shaft are rotating; and a motor for rotating the shaft with the impeller to centrifugally pump a liquid vertically in the shaft from the lower inlet end to the upper outlet end.

15 Claims, 3 Drawing Sheets

U.S. PATENT DOCUMENTS 4,406,594 A * 9/1983 Smaby et al. ..... 417/368
4,421,453 A * 12/1983 Hoff et al. ..... 415/88
4,432,693 A * 2/1984 Hackbart ..... 415/88
4,470,772 A * 9/1984 Gannaway ..... 417/368
4,724,928 A * 2/1988 Lewis et al. ..... 184/6.18
4,747,471 A * 5/1988 Ballentine et al. ..... 184/6.18
4,898,520 A 2/1990 Nieter et al.
5,017,108 A * 5/1991 Murayama et al. ..... 418/55.6
5,201,633 A 4/1993 Peu
5,372,490 A * 12/1994 Fain ..... 418/55.6
5,707,220 A * 1/1998 Krueger et al. ..... 417/423.12
5,803,718 A * 9/1998 Woo ..... 417/372
6,171,080 B1 1/2001 Watanabe et al.
6,171,090 B1 * 1/2001 Hurley ..... 418/94
6,182,794 B1 * 2/2001 Lee ..... 184/6.18
6,227,797 B1 * 5/2001 Watterson et al. ..... 415/107
6,450,785 B1 * 9/2002 Dellby et al. ..... 417/410.3
6,484,846 B1 * 11/2002 Parker ..... 184/6.16
6,484,847 B2 * 11/2002 Paczuski ..... 184/6.16
6,499,971 B2 * 12/2002 Narney et al. ..... 417/410.3
6,685,447 B2 2/2004 Mabe et al.
6,854,955 B2 * 2/2005 Shaffer et al. ..... 415/72
7,371,058 B2 * 5/2008 Jung et al. ..... 418/88
2005/0191192 A1 9/2005 Heng et al.
2006/0110263 A1 * 5/2006 Seo ..... 417/244
2009/0257900 A1 10/2009 Beers et al.
2011/0027117 A1 2/2011 Fujino et al.
2011/0150690 A1 * 6/2011 Tang et al. ..... 418/55.6

* cited by examiner

VERTICAL SHAFT PUMPING SYSTEM WITH LUBRICANT IMPELLER ARRANGEMENT

BACKGROUND

Vapor cycle refrigeration systems are used to control the temperature of many commercial and household refrigeration systems. They often utilize electric motor driven scroll compressors that require oil lubrication. Vapor cycle scroll compressors (or other vertically mounted rotating machinery) generally rely on lubricating oil distribution by oil entrained in the refrigerant being circulated throughout the system. When more positive pumping is required, it is often accomplished by having the lower end of a vertical rotating shaft extend into a lubricant reservoir. In some applications the vertical shaft can incorporate an eccentric hole along its length to accomplish a pumping action to lift oil from a lower reservoir section into and through the shaft. Oil then egresses the shaft through holes at its upper end to lubricate the elevated elements. Because the shaft is vertical in the system, a reservoir of oil and refrigerant often forms in lower portions of the unit.

SUMMARY

A vertical shaft pumping system includes a hollow shaft with an inner bore, an inlet end and an outlet end, the outlet end with at least one liquid distribution hole. It further includes an impeller positioned at the inlet end of the shaft, with a cylindrical base portion with a lower end, a central hole for drawing fluid into the shaft, and a plurality of teeth extending upwards from the cylindrical base portion and extending radially from the central hole to the outer cylindrical circumference for increasing tractive force of liquid in the shaft when the impeller and shaft are rotating; and a motor for rotating the shaft with the impeller to centrifugally pump a liquid vertically in the shaft from the inlet end to the outlet end.

DETAILED DESCRIPTION

Figure 1:
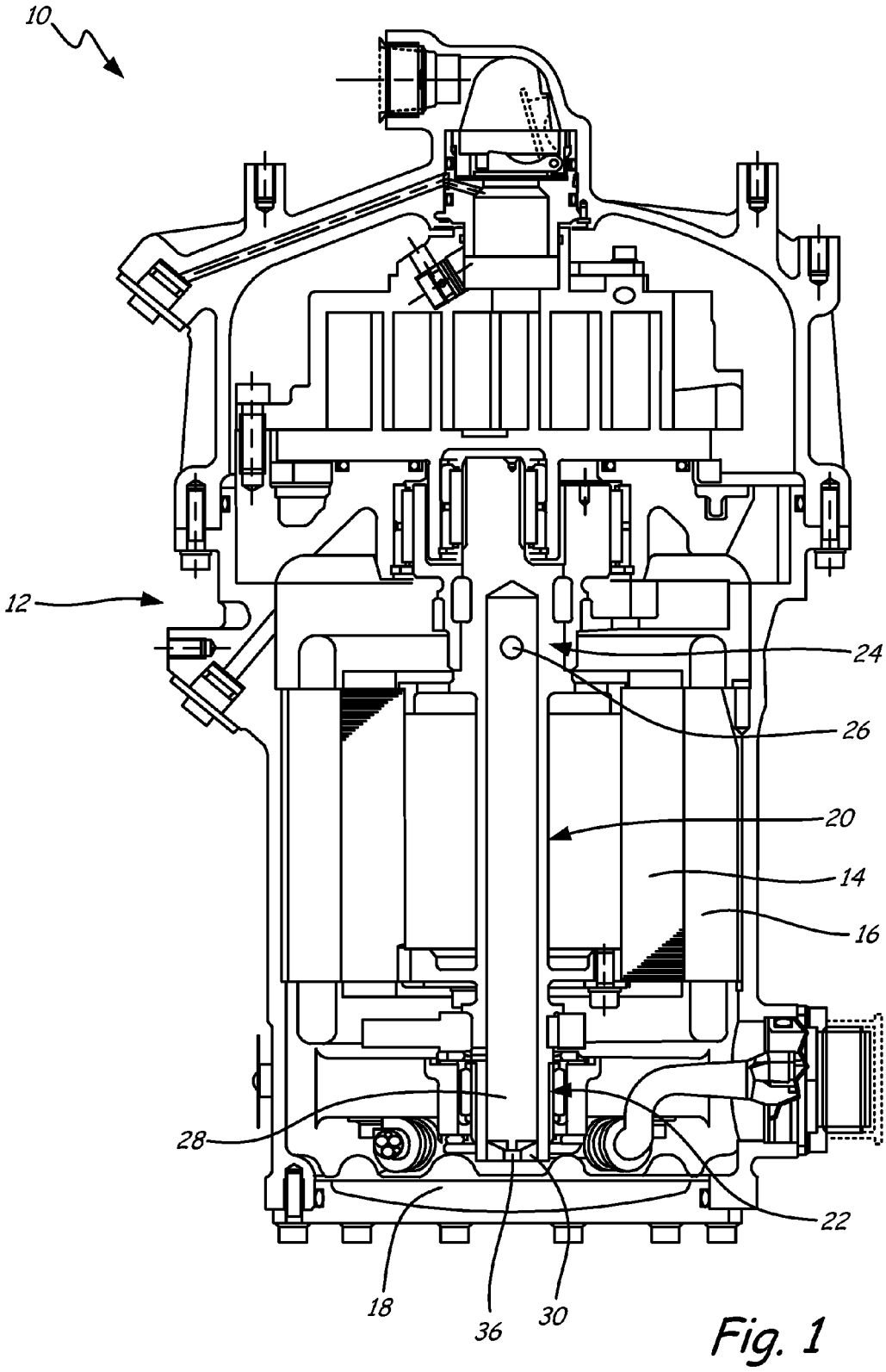
FIG. 1 is view of a scroll compressor and showing a cross-sectional view of a vertical shaft pumping system according to the present invention within the scroll compressor.

FIG. 1 is view of a scroll compressor and showing a cross-sectional view of a vertical shaft pumping system according to the present invention within the scroll compressor. Scroll compressor 10 includes upper scroll and bearing elements 12, motor rotor 14 and stator 16, lubricant reservoir 18, and vertical shaft 20 (with lower end 22, upper end 24, at least one hole 26 in upper end 24, inner bore 28 and impeller 30 with central hole 36). Lower end 22 of vertical shaft 20 extends into lubricant reservoir 18.

Upper scroll and bearing elements 12 of scroll compressor 10 require lubrication. The lubricant contained in lubricant reservoir 18 can be used for this purpose. Vertical shaft 20 is positioned so that lower end 22 with impeller 30 sit in lubricant reservoir 18. This enables lubricant to enter vertical shaft through central hole 36 in impeller 30. Shaft 20 is attached to motor rotor 14 by a press-fit or other method generally known in the art. Motor rotor 14 rotates vertical shaft 20 with impeller 30. This rotation creates a vortex with centrifugal force causing lubricants to travel upward from reservoir 18 through central hole 36 of impeller 30, and through vertical shaft 20 to upper end 24 of shaft 20. Lubricants then exit vertical shaft 20 in the radial direction through one or more holes 26 to lubricate upper scroll and bearing elements 12.

Figure 2:
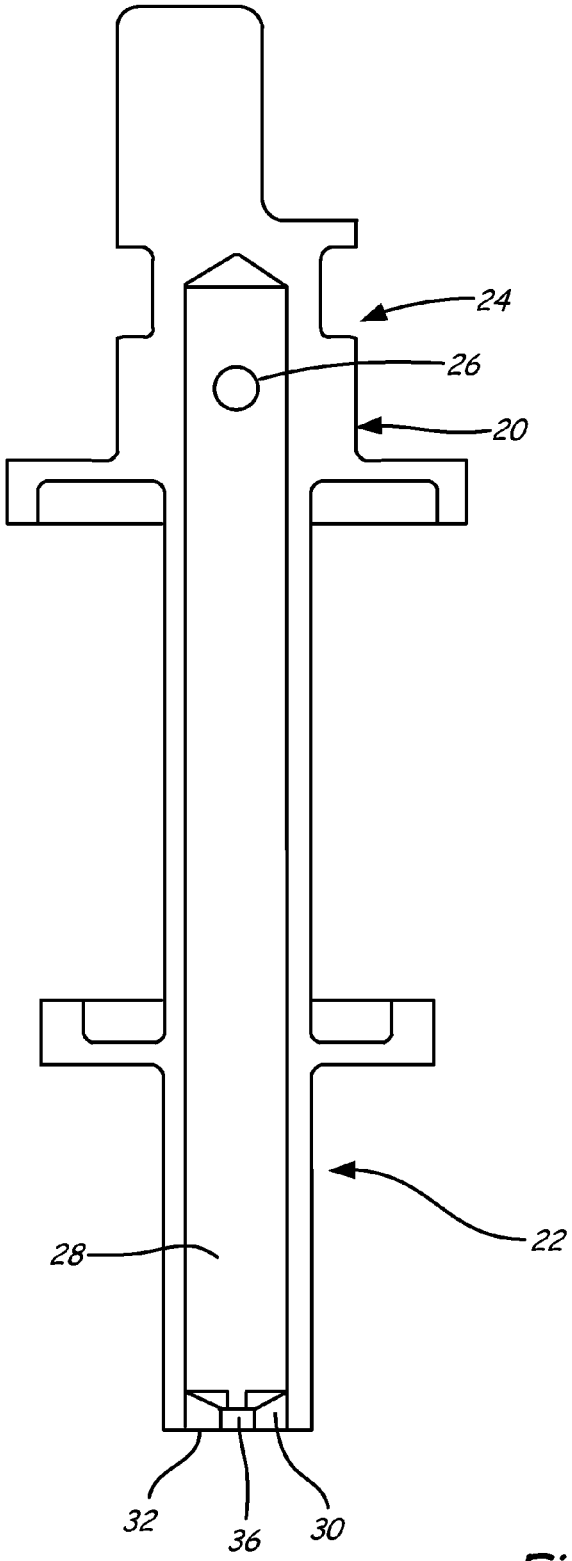
FIG. 2 is a close-up cross-sectional view of the vertical shaft pumping system of FIG. 1.

FIG. 2 is a close-up cross-sectional view of the vertical shaft pumping system of FIG. 1, and includes shaft 20 with lower end 22, upper end 24 with one or more holes 26, inner bore 28 and impeller 30 (with lower surface 32 and central hole 36). Impeller 30 is located at lower end 22 of inner bore 28 of shaft 20 and lower surface 32 of impeller 30 generally sits flush with the end of shaft 20. Impeller 30 can be integral to shaft 20 or can be pressed, welded, soldered, brazed or bonded into the shaft 20. The outer circumference of impeller 30 is against the inner wall of inner bore 28 of shaft 20 if it is an insert.

Impeller 30 assists in helping the lubricant travel up vertical shaft 20 by increasing the rotational velocity of the lubricant being vertically pumped up through central hole 36 in impeller 30. This increase in rotational velocity creates a uniform vortex of lubricant through centrifugal force. This uniform vortex is accomplished by increasing the tractive force at the boundary layer between the lubricant and shaft 20 through the shape and positioning of impeller 30.

For maximum pumping in a vertical pumping system, the lubricant should rotate at the same speed as shaft 20. However, due to the inertia of the lubricant and the boundary layer at the interface of the lubricant, the lubricant will generally rotate at a speed less than shaft 20. Past systems incorporated eccentric holes in a vertical shaft along its length to create centrifugal action, causing the liquid to flow up through the shaft based on increasing radial position of the hole centerline. While these eccentric holes did cause the liquid to pump up the vertical shaft, they created inherent unbalance in the rotating assembly. Additionally, shafts with these eccentric holes were difficult to manufacture and control. The current invention provides a vertical pumping system that does not require additional moving parts and allows the use of a uniform hollow shaft by using impeller 30 to rotate with shaft 20 and increase tractive force and cause lubricant to pump vertically through shaft 20.

Figure 3A:
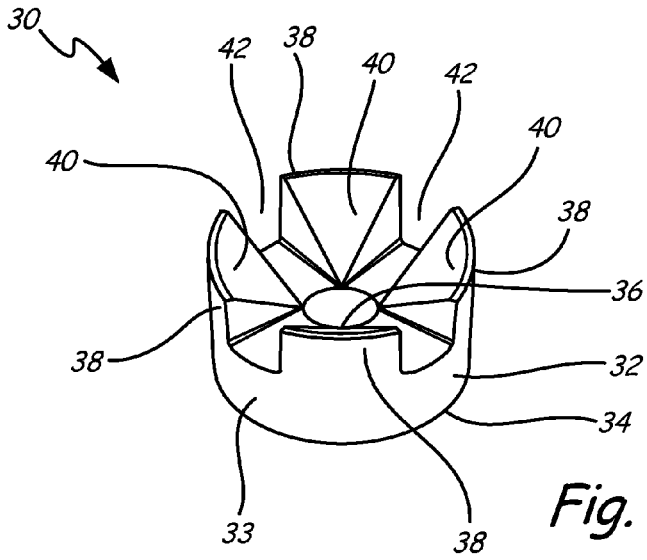
FIG. 3A is a perspective view of an impeller according to the present invention.
Figure 3B:
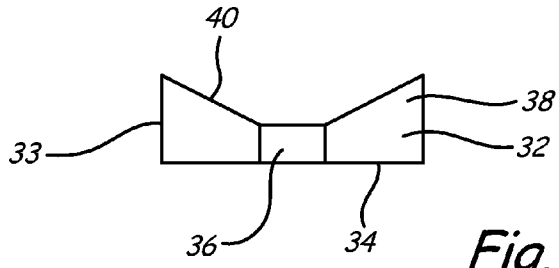
FIG. 3B is a cross-sectional view of the impeller of FIG. 3A.
Figure 3C:
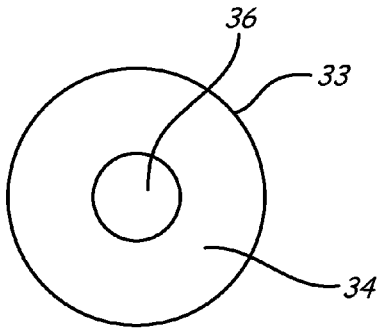
FIG. 3C is a bottom view of the impeller of FIG. 3A.
Figure 3D:
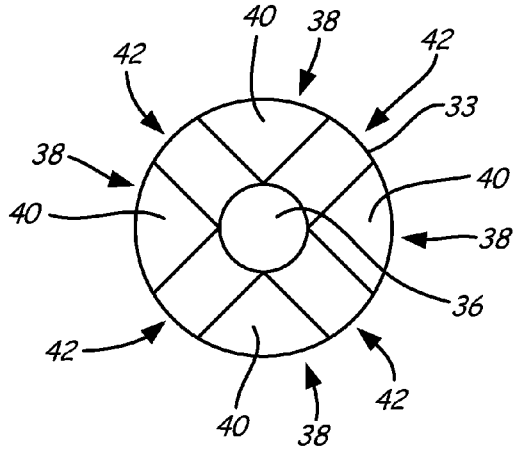
FIG. 3D is a top view of the impeller of FIG. 3A.

FIG. 3A is a perspective view of an impeller according to the present invention. FIG. 3B is a cross-sectional view of the impeller of FIG. 3A. FIGS. 3C are bottom and top views, respectively, of the impeller of FIG. 3A.

Impeller 30 includes cylindrical base section 32 with outer circumference 33, lower surface 34, central hole 36, and upper teeth 38 formed by slots 42. Upper teeth 38 include angled upper surfaces 40. Central hole 36 goes from lower surface 34 through upper surface of pump impeller 30. Upper surfaces 40 are angled upward from central hole 36 to outer circumference 33. The angle can be about 50 degrees from vertical, but may be more or less depending on system requirements. Alternatively, in some applications, upper surfaces 40 may not be angled, and upper surfaces 40 and lower surface 34 would be parallel. Slots 42 are located radially around pump impeller 30 extending from upper surfaces 40 towards lower surface 34 to form teeth 38 on top of base portion 32. The embodiment shown in FIGS. 3A-3B includes four slots 42 spaced equidistant radially around impeller 30 to form four teeth 38. Impeller 30 may include more or fewer slots 42 and teeth 38 depending on system requirements.

Dimensions of pump impeller 30, including central hole; outer circumference; cylindrical base section; number, shape and size of teeth; angles of upper surface; etc; may vary depending upon factors such as inner diameter of the pumping shaft, shaft speed of rotation, surface conditions of the inner diameter of pump shaft, the height to which liquid must be pumped in the shaft, the amount of liquid to be pumped up the shaft, properties of the liquid being pumped, depth the shaft extends into the liquid, and depth of liquid below the shaft. Impeller 30 can be made of plastic or any other material compatible with pumping system and liquid to be pumped.

Pump impeller 30 is located at the base of shaft 20 and sits in lubricant reservoir 18 (see FIGS. 1-2). Lubricant enters shaft 20 through central hole 36. Shaft 20 rotates, and impeller 30 with slots 42 and teeth 38 with angled upper surfaces 40 help to increase tractive force at the boundary layer between the lubricant being vertically pumped and shaft 20, thereby increasing the rotational velocity of the lubricant in shaft 20. This creates a uniform vortex of lubricant for more effective and efficient vertical pumping out of a reservoir without requiring additional mechanical parts. The pumping effectiveness can be further enhanced by roughening the inner surface of the inner bore of the shaft to increase the tractive force. Such a condition will tend to increase the rotating speed of the lubricant film to more closely match that of the shaft. Roughening can be done by adding rifling or superficial surface irregularities, or any other suitable method.

In summary, the vertical pumping system of the current invention uses a pump impeller to accomplish pumping of a liquid using a light-weight uniform hollow shaft. The pump impeller includes a central hole which the liquid enters and includes slots and teeth to increase tractive force while rotating. This helps to create a uniform vortex of lubricant with centrifugal action. It can also include angled upper surfaces on the teeth to further increase tractive forces, resulting in increased rotational velocity of the lubricant being pumped in the shaft, therefore further improving pumping. Because it is a passive pumping system (not requiring additional moving pumping elements), reliability and durability are maximized. The current invention also has minimal manufacturing costs compared to past systems using shafts with eccentric holes which were difficult and costly to manufacture.

While the invention has been discussed in relation to use in a scroll compressor, it can be adapted into other vertically oriented rotating assemblies. Angles and dimensions of pump impeller are shown for example purposes only, and can be varied depending on system requirements.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A vertical shaft pumping system comprising:

a hollow shaft with an inner bore, a lower end with an inlet and an upper end with an outlet, the upper end with at least one liquid distribution hole;

an impeller positioned at the lower end of the shaft, with a cylindrical base portion with a lower end, a central hole for drawing fluid into the shaft, an outer cylindrical circumference and a plurality of teeth extending upwards from the cylindrical base portion and extending radially from the central hole to the outer cylindrical circumference for increasing tractive force of liquid in the shaft when the impeller and shaft are rotating, with each of the plurality of teeth having an upper surface that is angled radially and each of the teeth being separated by a radial slot extending from the central hole to the outer cylindrical circumference; and a motor for rotating the shaft with the impeller to centrifugally pump a liquid vertically in the shaft from the inlet end to the outlet end.

2. The vertical shaft pumping system of claim 1, wherein the upper surface is angled radially upward from the central hole to the inner bore of the hollow shaft.

3. The vertical shaft pumping system of claim 1, wherein the lower end of the shaft is immersed in the liquid.

4. The vertical shaft pumping system of claim 1, wherein the system is for use in a scroll compressor.

5. A pump shaft for centrifugally pumping a liquid comprising:

a hollow shaft with an inner bore, an inlet end and an outlet end, the outlet end with at least one liquid distribution hole; and an impeller positioned at the inlet end within the inner bore and with a central hole for drawing fluid into the hollow shaft, a cylindrical outer circumference, a lower surface, an upper surface, and a plurality of slots extending radially from the central hole to the cylindrical outer circumference and starting at the upper surface extending towards the lower surface, wherein the upper surface of the impeller is angled in the radial direction, the upper surface located between the lower surface and the outlet end.

6. The pump shaft of claim 5, wherein the impeller is an integral part of the hollow shaft.

7. The pump shaft of claim 5, wherein the impeller is fabricated separately from the hollow shaft and is inserted into it.

8. The pump shaft of claim 5, wherein the plurality of slots are pairs of slots which radially mirror each other in the impeller.

9. The pump shaft of claim 5, where the impeller includes four slots spaced equidistant around circumference of the impeller.

10. The pump shaft of claim 5, wherein the impeller has a greater length from the lower surface to the upper surface at the outer circumference than at the central hole.

11. The pump shaft of claim 5, wherein the inner bore surface is roughened.

12. An impeller for insertion into a rotatable vertical pump shaft with an inner bore, an inlet end and an outlet end, the impeller comprising:

a cylindrical base portion with an outer circumference that sits against the shaft inner bore so that the impeller rotates when the shaft rotates and a lower end that is located on the inlet end of the shaft;

a central hole for drawing fluid into the pump shaft; and a plurality of teeth extending upwards from the cylindrical base portion and extending radially from the central hole to the outer circumference for increasing tractive force of liquid in the pump shaft when the impeller is rotating with the shaft, each of the plurality of teeth with an upper surface that is angled upward from the central hole to the outer circumference of the cylindrical base portion, wherein each of the plurality of teeth are separated by a radial slot extending from the central hole to the outer circumference.

13. The impeller of claim 12, wherein the upper surface is angled upward at about 50 degrees from vertical.

14. The impeller of claim 12, wherein the plurality of teeth are radially oriented and approximately equally spaced.

15. A method of operating a vertical shaft pumping system, the method comprising:

positioning a vertical shaft with an impeller at a lower end of the shaft so that the lower end of the shaft is immersed in a lubricant reservoir; and rotating the shaft so that lubricant in the lubricant reservoir is drawn into the shaft through the impeller and vertically pumped up the shaft through centrifugal action, wherein the impeller comprises:

a cylindrical base portion with an outer circumference that sits against the shaft inner bore so that the impeller rotates when the shaft rotates and a lower end that is located on an inlet end of the shaft;

a central hole for drawing fluid into the pump shaft; and a plurality of teeth extending upwards from the cylindrical base portion and extending radially from the central hole to the outer circumference for increasing tractive force of lubricant in the pump shaft when the impeller is rotating with the shaft, each of the plurality of teeth with an upper surface that is angled and each of the plurality of teeth separated from the other teeth with a slot extending radially from the central bore to the outer circumference.

* * * * *